United States Patent [19]

Scheffer

[11] 4,421,501

[45] Dec. 20, 1983

[54] WEB FOLDING APPARATUS

[76] Inventor: Bruce A. Scheffer, 3819 W. 90th Ct., Merrillville, Ind. 46410

[21] Appl. No.: 340,421

[22] Filed: Jan. 18, 1982

[51] Int. Cl.[3] ..... B65H 45/22

[52] U.S. Cl. ..... 493/439; 493/456

[58] Field of Search ..... 493/243, 436, 438–440, 493/455–456, 461–462, 446, 447

[56] References Cited

U.S. PATENT DOCUMENTS

| | | | |
|---|---|---|---|
| 1,625,178 | 4/1927 | Wheildon | 493/439 |
| 2,023,734 | 12/1935 | Lomatsch | 493/439 |
| 3,216,720 | 11/1965 | Sano | 493/439 |
| 3,655,500 | 4/1972 | Johnson | 493/439 X |
| 3,799,536 | 3/1974 | Gregoire | 493/436 X |
| 4,047,711 | 9/1977 | Gregoire | 493/243 X |
| 4,231,560 | 11/1980 | Stohlquist | 493/439 X |

FOREIGN PATENT DOCUMENTS

| | | | |
|---|---|---|---|
| 946816 | 1/1964 | United Kingdom | 493/439 |

*Primary Examiner*—A. J. Heinz

*Attorney, Agent, or Firm*—Welsh & Katz

[57] ABSTRACT

Apparatus for use in folding web material includes a plow folder supported intermediate transverse entrance and exit rollers and cooperative therewith to effect longitudinal folding of the web as it moves longitudinally through the apparatus. In a preferred embodiment, the plow folder includes at least one rotatable cylindrical web engaging roller and a fold forming member coaxial with the web engaging roller and having a partial cylindrical outer peripheral surface and an axially outwardly facing fold surface subtending an acute angle with the longitudinal axis of the folder forming member. Air orifices are formed in the outer peripheral surface of the fold forming member to facilitate air lubrication between the fold forming member and the moving web. The plow folder is adjustable vertically and laterally to facilitate different fold widths, and the fold forming member is selectively rotatably adjustable about its longitudinal axis to optimize folding of different type web materials without forming wrinkles or gussets at the fold line and without marking the web. The plow folder is supported on a support frame which enables substantially 180° pivotal movement of the plow folder between upwardly and downwardly directed positions relative to the main frame for upward and downward folding. A fold holding roller is mounted to extend transversely of the folded web and is adjustable to selectively vary the pressure applied against the folded web to prevent unfolding.

33 Claims, 13 Drawing Figures

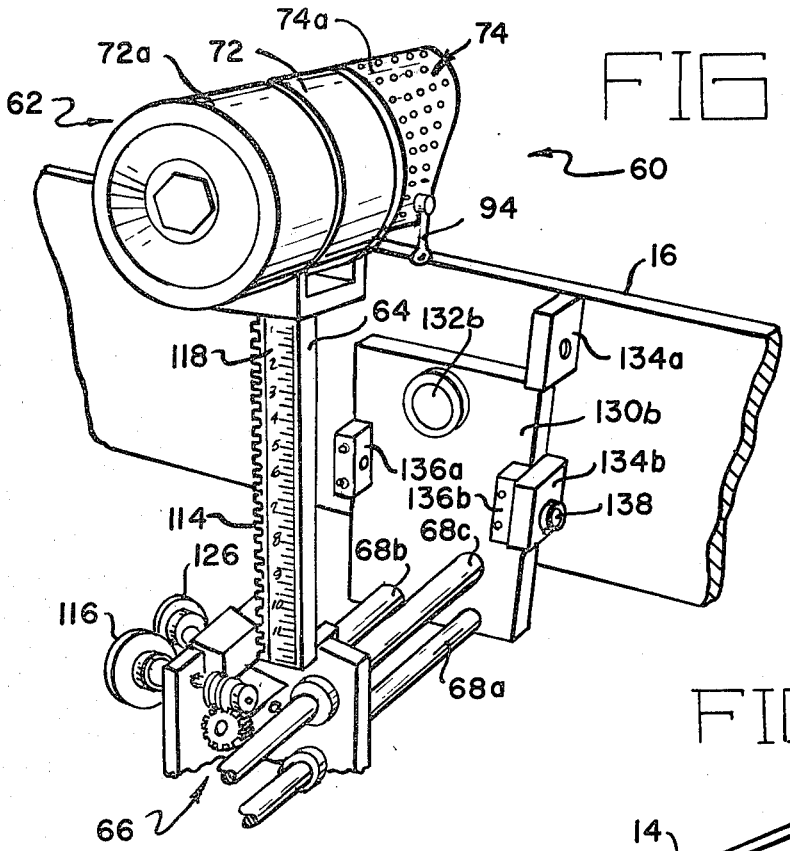
FIG 7
FIG 8
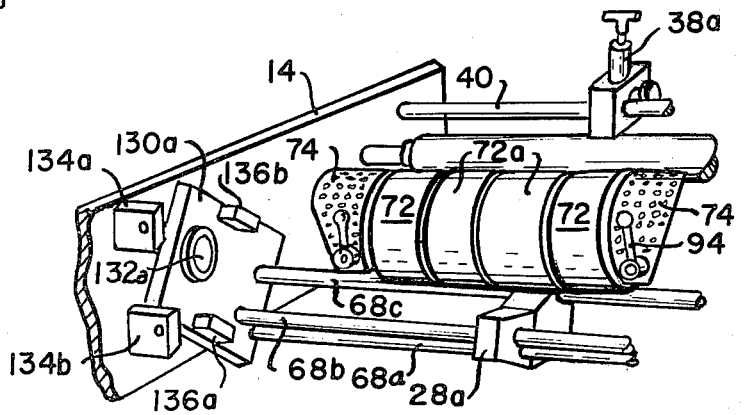
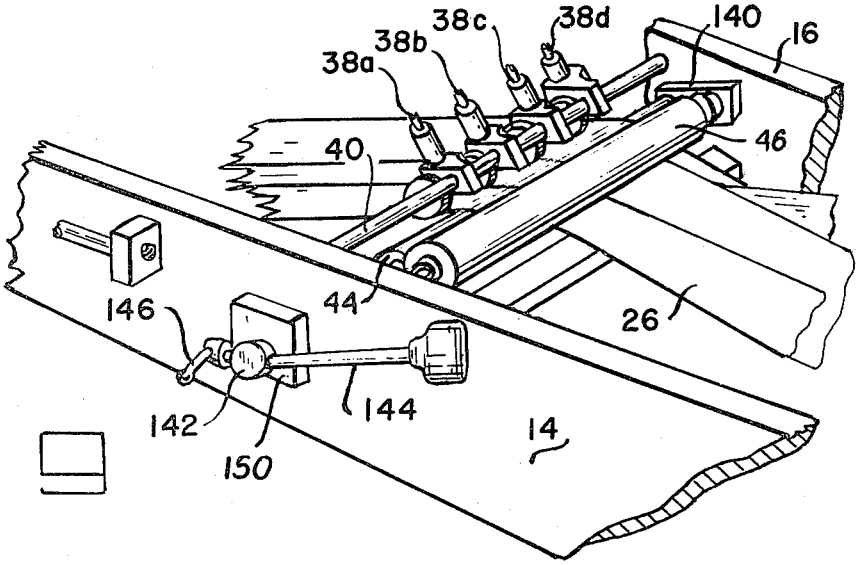
FIG 9

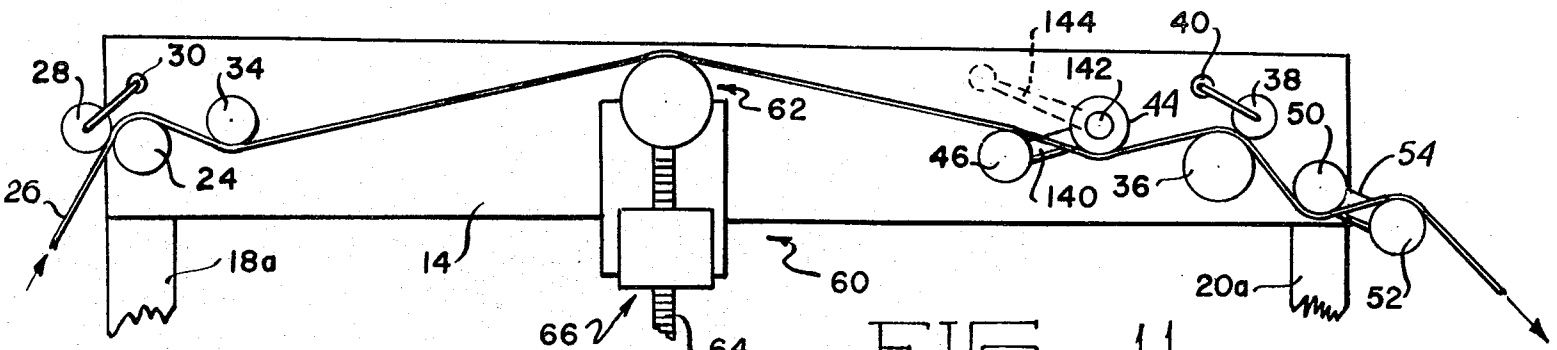
FIG 11
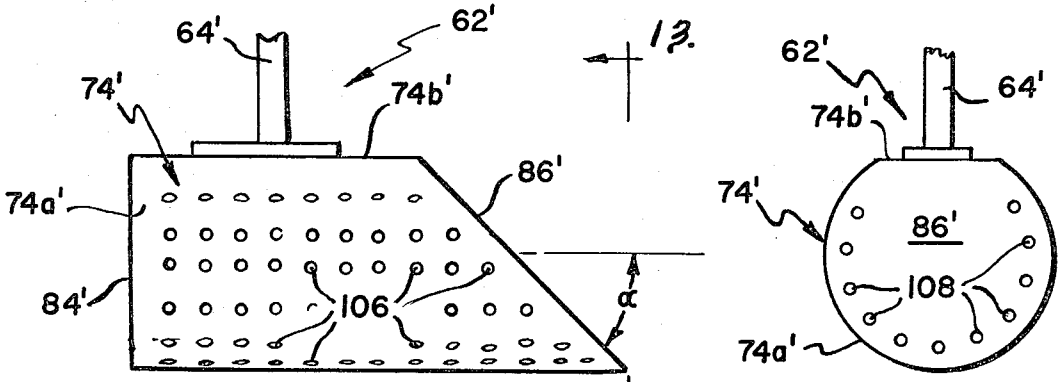
FIG 12
FIG 12
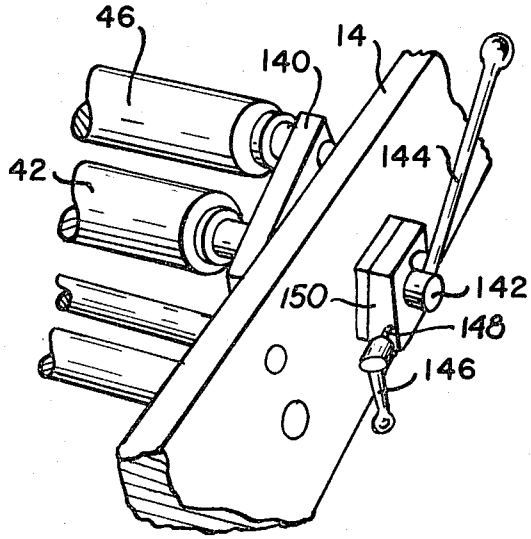
FIG 10

WEB FOLDING APPARATUS

BACKGROUND OF THE INVENTION

The present invention relates generally to apparatus for folding a continuous length of web material along a longitudinal fold line, and more particularly to a web folding apparatus having novel features which enable highly efficient folding of a continuous length web material without forming wrinkles or gussets and without marking the web, and which facilitate on-going adjustment to accommodate different type web materials.

Apparatus for folding continuous length web material along a longitudinal fold line as the web material is moved longitudinally are generally known. Such apparatus find particular application in the folding of paper web material as it is passed from a printer to a cutter and sheeter. One type of apparatus for folding web material employs a frame on which transverse entrance and exit rollers are mounted for passage of a web material from the entrance to the exit roller and between which a fold forming mechanism is supported for cooperation with the entrance and exit rollers to fold the web material longitudinally. A significant problem which exists with known web folding apparatus is the formation of wrinkles or gussets at the fold line and marking of the web material in the area of the fold. While the problem of web marking is of particular significance in web folding apparatus employed in the printing industry, the problem of wrinkling or gusseting adversely affects the folding of substantially any web material which is folded generally longitudinally thereof.

Another significant problem found in the known prior web folding apparatus is that they are generally incapable of adjustment during movement of the web material, particular as affects adjustment of the fold former plow, so that shutdown of the apparatus is required for making fine adjustments as may be required to reduce problems of wrinkling or gusseting and marking of the web material, thus adding significantly to the cost of operation.

Still another problem which must be confronted in the longitudinal folding of many web materials is the tendency for the folded portion of the web to unfold following initial folding. While prior known web folding apparatus have attempted to address this problem, the various means suggested, such as goose neck type arm supported rollers and the like for engaging the folded web generally at the fold line, have not been found satisfactory.

SUMMARY OF THE INVENTION

One of the primary objects of the present invention is to provide a new and improved apparatus for folding continuous length web material longitudinally thereof, which apparatus substantially eliminates wrinkling or gusseting of the web material during folding while providing highly efficient operation.

Another object of the present invention is to provide an improved web folding apparatus for use in folding a web material as it is moved longitudinally, which apparatus substantially eliminates marking of the web material in the area of a longitudinal fold as has heretofore resulted with prior known apparatus.

Still another object of the present invention is to provide a new and improved apparatus for folding web material longitudinally thereof as the material is passed from an entrance roller to an exit roller, which apparatus includes novel fold forming mechanism which is readily and quickly adjustable so as to coperate with the entrance and exit rollers to selectively form upwardly or downwardly directed longitudinal folds.

Still another object of the present invention is to provide a new and improved plow folder having a fold forming member which is readily adjustable during a folding operation to substantially eliminate wrinkling or gusseting and marking of the web material so as to provide highly efficient folding of different types of web material without need for shutdown of the apparatus.

A feature of the fold forming member in accordance with the invention lies in the provision of a cylindrical outer surface portion on the fold forming member and an axially outwardly facing fold surface which lies in a plane subtending an acute angle with the longitudinal axis of the fold forming member, the fold forming member being rotatably adjustable about its longitudinal axis so as to optimize support of the folded web portion to prevent wrinkling or gusseting of the web at the fold line.

Another feature of the present invention lies in the provision of fluid discharge orifices in the outer peripheral surface of the fold forming member to facilitate fluid lubrication between the fold forming member and a moving web material being folded.

Yet another feature of the present invention lies in the provision of means for supporting the plow folder mechanism for pivotal movement about an axis substantially transverse of the path of movement of the web material so as to enable positioning of the plow folder between upwardly and downwardly directed positions to facilitate upward or downward folding of the web material without need for interchanging elements of the apparatus.

Still another feature of the present invention lies in the provision of a novel fold holding roller which is adjustable to provide selected uniform pressure application against the entire surface of the folded web in a manner to prevent unfolding of the folded web.

Further objects, advantages and features of the present invention, together with the organization and manner of operation thereof, will become apparent from the following detailed description of the invention when taken in conjunction with the accompanying drawings wherein like reference numerals designate like elements throughout the several views.

BRIEF DESCRIPTION OF THE DRAWINGS

FIG. 7 is a fragmentary perspective view illustrating the pivotal mounting arrangement for the plow folder mechanism;

FIG. 8 is a fragmentary perspective view similar to FIG. 7 but showing the plow folder mechanism in an intermediate position between its upward and downward operating positions;

FIG. 9 is a fragmentary perspective view illustrating the fold holding roller and associated exit idler roller employed in the apparatus of FIG. 1;

FIG. 10 is a fragmentary perspective view showing the pressure adjustment control lever and associated locking arrangement for the fold holder roller;

FIG. 11 is a diagrammatic side view of the apparatus of FIG. 1 illustrating the relative positions of the various rollers in relation to the plow folder mechanism during downward folding of a continuous web material.

FIG. 12 is an elevational view of an alternative fold forming member; and

FIG. 13 is an end view of the fold forming member of FIG. 12, taken along line 13—13 of FIG. 12.

DESCRIPTION OF PREFERRED EMBODIMENTS

Figure 1:
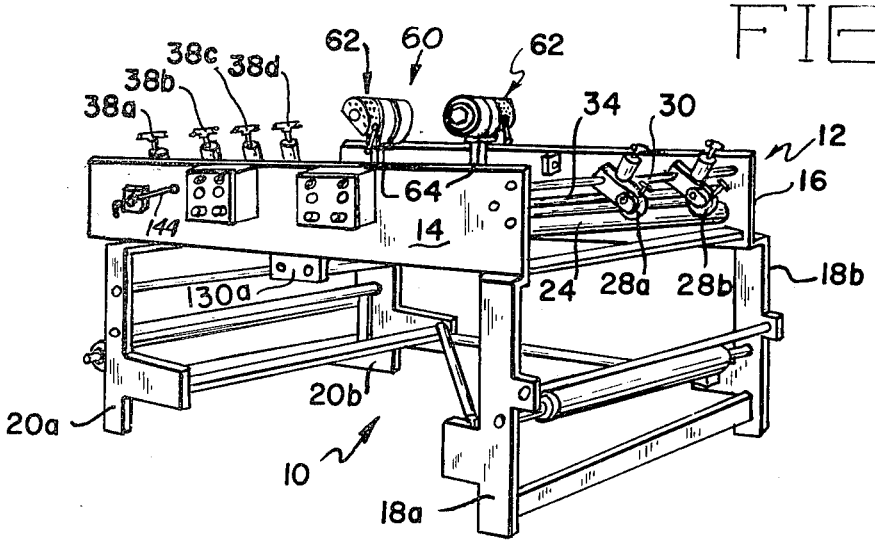
FIG. 1 is a perspective view of an apparatus for longitudinally folding a continuous web material in accordance with the present invention.
Figure 2:
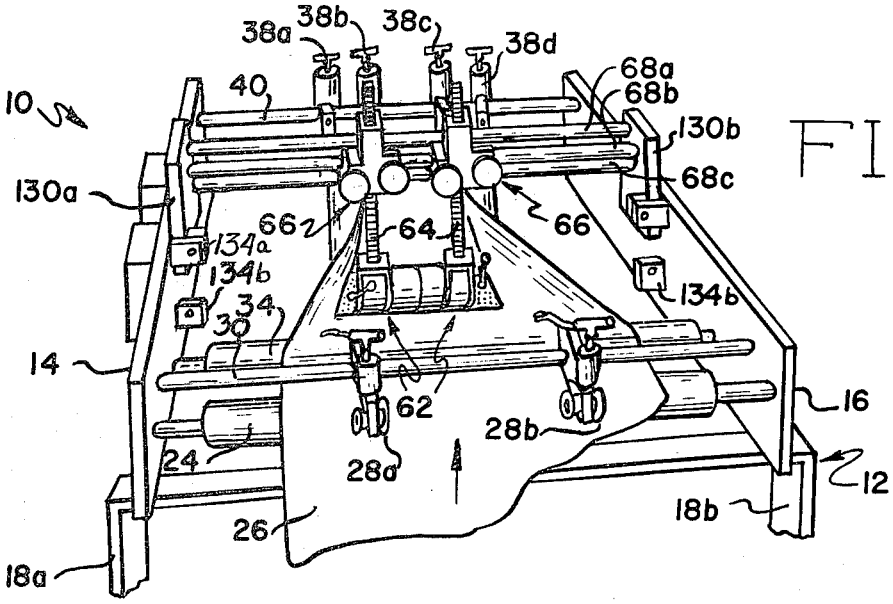
FIG. 2 is a perspective view of the apparatus of FIG. 1 as viewed from the entrance end but with the plow folder moved to a downwardly directed position so as to effect upward folding of laterally opposite portions of the web material.

Referring now to the drawings, and in particular to FIGS. 1 and 2, apparatus for longitudinally folding continuous web material in accordance with the present invention is indicated generally at 10. The apparatus 10, which may be termed a web folder or web folding apparatus or machine, finds application in the longitudinal folding of substantially any type of web material, such as various paper type materials and the like as well as various types of plastic web materials, which are capable of longitudinal movement through the web forming apparatus 10 and longitudinal folding in a manner to be hereinafter described.

As will become more apparent hereinbelow, the web folding apparatus 10 includes various features which enable adjustment during operation and longitudinal movement of the web material so as to optimize folding of different types of web material without wrinkling or gusseting at the fold line and without marking of the web material. Upward or downward plow folding may be readily accomplished and retention of the folded position of the web prevents unfolding. As used herein, the terms wrinkles or gussets are generally synonymous since gussets are generally defined as high tension wrinkles frequently formed along a fold by prior methods of plow folding. Marking is generally defined as smearing, scratching or smudging of printing ink on printed webs of paper.

The web folding apparatus 10 includes frame means, indicated generally at 12, having longitudinally extending, laterally spaced and parallel side frame members 14 and 16 the opposite ends of which are fixed to and supported by front and rear sets of upstanding support legs 18*a, b* and 20*a, b,* respectively. Suitable structural cross braces are provided between the side frame members and between the support legs as necessary to provide a rigid rectangular framework with the longitudinal axes of the side frame members lying substantially in a common horizontal plane.

With reference to FIGS. 1 and 2, taken in conjunction with FIG. 11, the end of the web folding apparatus 10 adjacent the support legs 18*a, b* comprises the entrance end of the folder and rotatably supports an entrance roller 24 between and transversely of the side frame members 14 and 16 in a conventional manner, such as by journaling the opposite ends of the entrance roller to the side frame members. In the illustrated embodiment, the entrance roller 24 comprises an idler roller having a hardened cylindrical surface to receive and support a continuous web material, such as indicated at 26 in FIGS. 2 and 11, which, as aforenoted, may comprise a paper web material or the like or a plastic sheet or web which lends itself to longitudinal folding.

One or more slitter wheels of conventional design, two of which are indicated at 28*a* and 28*b,* are mounted on a transverse support rod 30 for cooperating relation with the entrance roller 24 to effect slitting of the web material as it passes over the entrance roller. The slitter wheels 28*a, b* may have continuous annular cutting edges thereon or may have notched cutting edges to provide lines of perforations along the longitudinal length of the incoming web material, the slitter wheels being adjustable along the length of the support rod 30 so as to enable varying of the width of web between the lateral edges of the web and the respective slitter or perforating wheels. In the illustrated embodiment, pneumatic means are provided to actuate the slitter wheels and control the pressure applied againt the web material, although spring biased slitter or perforation wheels may also be employed. It will be appreciated that the entrance roller 24 may be power driven either by the drive motor of a printing press from which the web material 26 is received or by a separate power drive means. If the roller 24 is rotatably driven, nip or trolley wheels (not shown) are preferably mounted along the support rod 30 as is known. A transverse idler roller 34 is also preferably journaled to and transversely of the side frame members 14 and 16 slightly downstream of the entrance roller 24 and serves as an entrance web support roller.

An exit roller 36 is suitably rotatably supported by and transversely between the side frame members 14 and 16 adjacent the exit ends thereof opposite the entrance roller 24. The exit roller 36 also comprises a cylindrical roller which may be rotatably driven by the drive motor of an associated printing press through suitable drive belts (not shown) in a conventional manner so as to be slaved off the press drive motor, as is known. A plurality of nip or trolley wheels, four of which are employed in the illustrated embodiment and indicated at 38*a–d,* are supported on a transverse support shaft 40 so as to engage the web material against the peripheral drive surface of the driven exit roller 36 in a manner to draw the web material from the entrance roller 24.

A rear idler roller 44 of generally similar construction to the forward idler roller 34 is journaled to and between the frame members 14 and 16 and provides an exit web support roller in a manner which will become more apparent hereinbelow. In accordance with one feature of the invention, to be described in greater detail hereinafter, a transverse fold holding roller 46 is supported to extend transversely of the web being folded and is selectively operative to apply a uniform pressure against the entire surface of the folded web so as to prevent the folded web from unfolding.

A pair of parallel spaced rollers 50 and 52 are interconnected at their opposite ends through parallel connecting arms, one of which is indicated at 54 in FIG. 11, and are pivotally mounted to and between the side frame members 14 and 16 downstream from exit roller 36 for pivotal movement about the axis of roller 50. The idler rollers 50 and 52 receive the folded web 26 therebetween from the driven exit roller 36 and serve as a cut-to-print compensator of the type well known in the printing art, and need be described in greater detail herein.

If desired, web roll support and turning bars may be supported by the frame means 12 generally below the plane of the side frame members 14 and 16 and the various elements supported thereon, as illustrated in FIG. 1.

Figure 3:
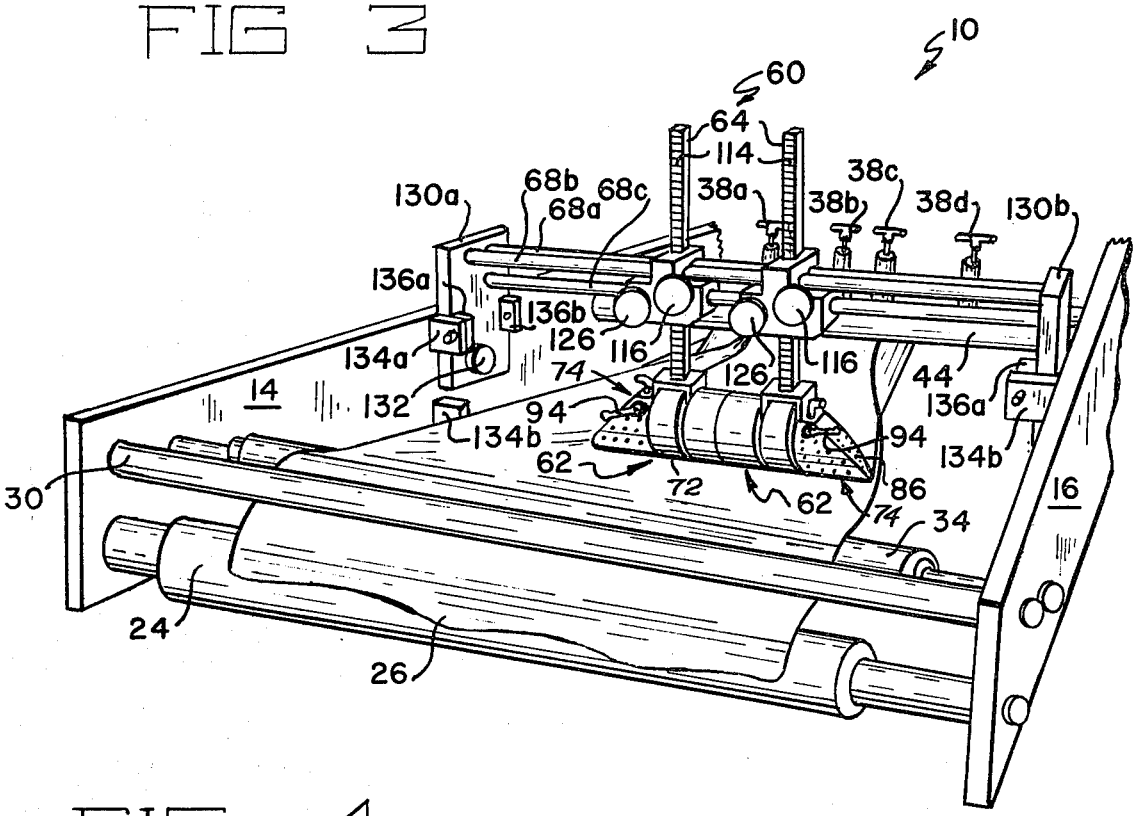
FIG. 3 is a fragmentary perspective view, on an enlarged scale, of the plow folder mechanism employed in the apparatus of FIGS. 1 and 2.

Folder mechanism of the plow folder type, indicated generally at 60, is supported by and between the frame members 14 and 16 intermediate the entrance and exit rollers 24 and 36, respectively, and is cooperative with the entrance and exit rollers to fold the web material 26 along a longitudinal fold line as it is moved longitudinally from the entrance roller 24 and forward idler roller 34 to the rear exit roller 36 and rear mounted idler roller 44. With particular reference to FIGS. 2 and 3, the plow folder mechanism 60 in the illustrated embodiment includes a pair of substantially identical plow folder heads each of which is indicated generally at 62 and is supported on support bracket means in the form of a support yoke or bifurcated support arm 64.

Each plow folder head 62 and its associated support arm or yoke 64 is supported by a discrete carrriage means 66 which, in turn, is adjustably movable along the length of guide track means in the form of three parallel spaced cylindrical rods 68*a, b* and *c* supported by and between the side frame members 14 and 16 in transverse relation thereto so as to lie substantially parallel to the axes of the entrance and exit rollers 24 and 36. In addition to facilitating lateral adjustment of the plow folder heads 62 between the side frame members 14 and 16, the carriage means 66 are cooperative with their associated support arms or yokes 64 and plow folder heads in a manner enabling vertical adjustable positioning of the plow folder heads relative to the path traversed by the web material 26 as it moves longitudinally from the entrance roller 24 to the exit roller 36. Stated alternatively, the carriage means 66 enable vertical adjustment of the positions of the associated folder heads 62 relative to a plane containing the axes of the entrance and exit rollers 24 and 36 for selective cooperation with the moving web 26 during longitudinal folding thereof.

Figure 5:
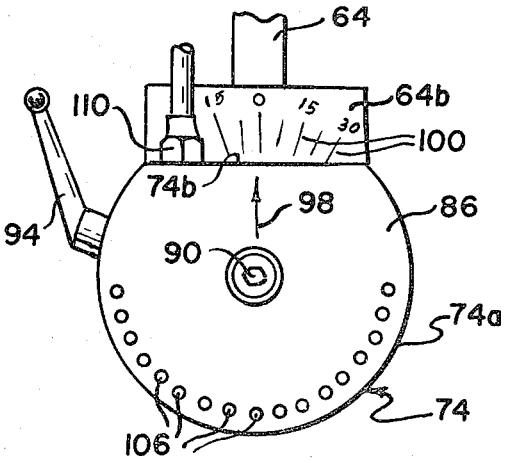
FIG. 5 is an end view of the plow former head of FIG. 4, taken substantially along line 5—5 of FIG. 4 and looking in the direction of the arrows.
Figure 6:
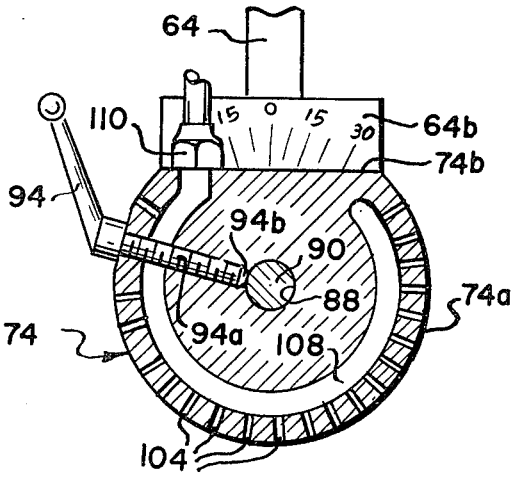
FIG. 6 is a transverse sectional view of the fold forming member, taken substantially along line 6—6 of FIG. 4 and looking in the direction of the arrows.
Figure 4:
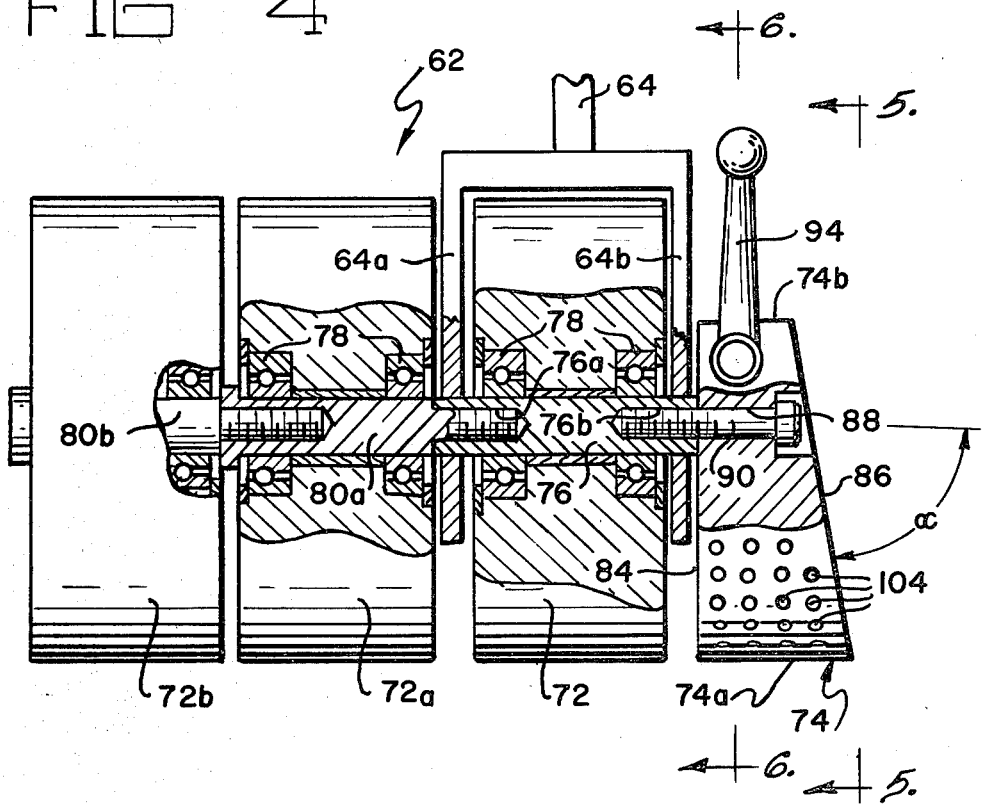
FIG. 4 is a front view of a single plow former head, portions of which are broken away for clarity.

Turning now to a more detailed description of the various features of the invention, and with particular reference to FIG. 3 taken in conjunction with FIGS. 4–6, each plow folder head 62 preferably includes at least one rotatable cylindrical web supporting or engaging roller 72 and a fold forming member 74 which is mounted in coaxial relation with the web engaging roller. In the illustrated embodiment, each plow folder head 62 supports a first web supporting roller 72 for rotation about an axle or support shaft 76 through suitable antifriction bearings 78, the shaft 76 being supported between bifurcated arm portions 64*a* and 64*b* of the associated support arm or yoke 64. The ends of the axle or support shaft 76 are non-rotatably received within suitable openings in the bifurcated arm portions as by forming flats on the ends of the support shaft which are received within similarly configured slots or openings in the bifurcated arms. The roller 72 and fold forming member 74 are preferably made of a suitable metallic material such as aluminum, and have approximately six inch diameters and a width of approximately three inches.

With particular reference to FIG. 4, the support axle 76 has threaded bores 76*a* and 76*b* formed in its opposite ends to facilitate mounting of the fold forming member 74 and additional identical cylindrical web supporting rollers, such as indicated at 72*a* and 72*b*, in coaxial tandem relation with the web supporting roller 72. To this end, each of the rollers 72*a* and 72*b* has an axial support shaft, indicated at 80*a* and 80*b*, respectively, having a male thread formed on one end and a female threaded bore formed in its opposite end to enable mounting of each roller support shaft on the support shaft of the next adjacent roller in coaxial relation therewith, the male and female threads being of compatable interfitting size. The use of three inch width web supporting rollers, such as 72, 72*a* and 72*b*, allow the longitudinal length of each plow folder head, and correspondingly the longitudinal length of the plow folding surface, to be selectively incrementally increased to the approximate width of the desired fold width. When employing two plow holder heads 62 in axial alignment, such as in FIG. 3, fine adjustment of the lateral positions of the plow holder heads through lateral positioning along the transverse guide rods 68*a, b* and *c*, enables setting of the plow folding surface to substantially the exact fold width desired along the opposite lateral edges of the web material.

Each of the fold forming members 74 has a partial cylindrical outer peripheral surface 74*a* so as to establish an outer right circular cylindrical surface portion which extends approximately 240° about the longitudinal axis of the cylindrical surface, as considered in the plane of FIG. 5. Each fold forming member 74 has a planar surface 84 perpendicular to the axis of the outer cylindrical surface portion 74*a* and has an axially outwardly facing uninterrupted planar fold surface 86 which lies in a plane subtending an acute angle with the longitudinal axis of the fold forming member, when considered in a plane containing the longitudinal axis of the fold forming member and intersecting the plane of the fold surface in perpendicular relation thereto. This angle is identified by the Greek letter alpha in FIG. 4 and has been found to be particularly satisfactory for folding paper when of a magnitude between approximately 45° and 75°. For relatively light paper, that is, paper web material having a basis weight less than 60 pounds, it has been found that an angle alpha of approximately 75° results in excellent folding without wrinkles or gusseting, while with relatively heavy weight paper stock or web material having a basis weight greater than 60 pounds, an angle alpha of 45° provides excellent folding without wrinkling or gusseting.

By releasably mounting the fold forming member 74 on bracket means 64, a fold forming member having a fold surface 86 which forms an angle alpha of approximately 75° ca be interchanged with a fold forming member having a fold surface 86 which forms an angle alpha of approximately 45°. It will be understood that other angular relations of the fold surface 86 to the longitudinal axis of the fold forming member may be satisfactory for folding web materials other than paper type web materials. It will also be understood that the angular relation of the planar fold surface 86 could be expressed as the angle subtended by the plane of the fold surface with a plane transverse to the longitudinal axis of the fold forming member, in which case the aforementioned 75° angle would be stated as a 15° angle.

Each fold forming member 74 has an axial bore 88 formed therethrough to receive a mounting axle or shaft 90 which is adapted for threaded connection with the threaded bore 76*b* of the mounting axle or shaft 76 to facilitate coaxial mounting of the fold forming members with the associated web engaging rollers 72.

The fold forming member 74 is rotatable about its support axle 90 and is adapted to be locked in a selected rotational position by a locking lever 94 having a right-hand threaded shaft portion 94*a* which is received within a radial tapped bore 96 in forming member 74 to intersect bore 88. An inner end 94*b* on the locking lever 94 is adapted to engage shaft 90 to lock member 74 in selected rotational position so that fine adjustment can be effected during folding of the web.

It will be appreciated that when the fold forming member 74 is rotated from a position wherein the plane of the fold surface 86 moves out of a position wherein it is perpendicular to the axis of support shaft 90, i.e., normal to the plane of FIG. 4, a compound angular relationship is established between the plane of fold surface 86 and its rotational axis 90 and thus the plane of the web material. As will become more apparent hereinbelow, such adjustment of the fold forming member and orientation of the fold surface 86 facilitates optimum folding of different types of web material having different characteristics of weight and tension, as well as for various fold widths.

To facilitate visual observation of the relative position of the fold forming member 74 about its rotational axis 90, and to thereby facilitate adjustment of the fold forming member to a known preferred rotational position for operation with a given web material, the fold forming member 74 and bracket means 64 have mutually cooperating indicia or markings thereon which enable such predetermined rotational positioning. In the illustrated embodiment, the fold surface 86 has an arrow, indicated at 98, formed in its surface the head of which is adapted for registration with angular markings, shown at 100, formed in the adjacent outwardly facing surface of the bifurcated arm portion 64*b* of the support bracket 64.

As illustrated in FIGS. 4 and 6, each fold forming member 74 has a plurality of fluid discharge orifices or passages intersecting its outer peripheral surface which are adapted for connection to a source of fluid, such as air, so as to enable discharge of fluid to establish a fluid lubrication film between the fold forming member and the moving web material. In the illustrated embodiment, a plurality of fluid discharge orifices or passages are formed in each fold forming member to intersect both its outer peripheral cylindrical surface portion 74*a*, as indicated at 104, and also the fold surface 86, as indicated at 106. The fluid discharge orifices or passages 104 and 106 are connected in fluid communication with an arcuately shaped plenum chamber 108 which is preferably equidistantly spaced about the axis of the fold forming member. The plenum chamber 108 communicates with a connector fitting 110 preferably mounted on an upper flat surface 74*b* on the fold forming member, the connector fitting being connected through a suitable fluid flow line to a source (not shown) of fluid such as air under suitable pressure.

The discharge orifices 104 are preferably generally uniformly distributed over the cylindrical surface portion 74*a* of each of the fold forming members 74, while the discharge orifices 106 formed in the fold surface 86 may be formed in a generally arcuate path in relatively close proximity to the cylindrical surface 74*a*, as shown in FIG. 5.

FIGS. 12 and 13 illustrate an alternative embodiment of a plow folder head, indicated generally at 62', which eliminates the web supporting rotatable rollers 72 and employs a fold forming member 74' which is shaped generally similar to the aforedescribed fold forming member 74 except that its longitudinal axis is approximately equal to the full longitudinal length of the coaxially mounted web engaging rollers 72 and the fold forming member 74. The web folding member 74' has a cylindrical surface portion 84 which extends about its longitudinal axis an arcuate extent of approximately 240°, and has a planar end surface 74' normal to its longitudinal axis and a planar fold surface 86' which lies in a plane subtending an angle alpha with the longitudinal axis of between approximately 45° and 75° depending upon the characteristics of the web material being folded.

The web folding member 74' has an upper flat surface 74*b'* by which the fold forming member 74' is secured to the lower end of bracket means 64' for adjustable support in a similar fashion to the plow folder head 62. The cylindrical surface portion 74*a'* and the fold surface 86' have fluid discharge orifices 104' and 106', respectively, formed therein which are adapted for connection to a source of fluid such as air to facilitate establishment of a fluid lubrication film between the fold forming member 74' and a web material. While the illustrated fold forming member 74' is not rotatable about its longitudinal axis relative to the bracket means 64', provision for such a rotational mounting is envisioned.

To enable vertical adjustment of the plow folder head 62 relative to the transverse guide track rods 68*a, b* and *c*, and thus vertical adjustment relative to the plane of the web material passing from the entrance rollers 24 and 34 to the exit rollers 36 and 44, each upstanding support arm 64, which preferably is made rectangular in transverse cross section, has rack gear teeth formed along one of its side surfaces, such as shown at 114. Each support arm 64 is suitably connected to the carriage means 66 so that the rack gear teeth 114 intermesh with a spur gear carried by the carriage and having a manual control knob 116 so that rotation of the knob 116 is operative to raise and lower the associated support arm 64 and corresponding plow folder head 62.

To provide a visual indication of the relative position of each support arm 64 and its associated plow folder head 62, a number scale or other suitable indicia, such as indicated at 118, is formed on one of the remaining three side edges of each support arm 64 which is registrable with a suitable marking or edge surface on the carriage 66 so as to provide the operator with a visual indication of the relative position of the plow folder head relative to a horizontal plane containing the transverse rotational axis for the folder mechanism 60 to be described hereinbelow.

The carriage means 66 is mounted on and slidable along the parallel guide rods 68*a, b* and *c* of the guide track means so as to be slidable along the guide rods for lateral positioning between the side frame members 14, 16. To facilitate such lateral positioning of the carriage means 66 and associated plow folder heads 62, at least one of the guide track rods, such as 68*a*, has rack gear teeth formed along its longitudinal length for cooperation with a spur gear carried by each carriage means 66.

The spur gears are rotatable through manual control knobs 126 to facilitate selective lateral adjustment of the carriage means and associated plow folder heads.

With particular reference to FIGS. 7 and 8, the guide track rods 68, *a, b* and *c* have their opposite ends connected to support plates 130*a* and 130*b* which are pivotally mounted on stub shafts 132*a* and 132*b*, respectively, fixed to the inside surfaces of the frame members 14 and 16 so as to extend inwardly therefrom in axially aligned relation transverse to the side frame members. In this manner, the guide track rods 68*a–c* and the associated carriage means 66 and plow folder heads 62 may be rotated about the rotational axis defined by the stub shafts 132*a, b*.

In the illustrated embodiment, stop means in the form of a pair of stop blocks 134*a* and 134*b* are fixedly secured to the inner surface of each of the frame members 14 and 16 so as to extend inwardly thereof in laterally opposed pairs. The stop blocks 134*a* and 134*b* are adapted for cooperation with stop members 136*a* and 136*b* secured on the mounting plates 130*a* and 130*b* so as to establish fixed rotational positions of the folder mechanism 60 between a first position wherein the support arms 64 extend substantially vertically with the plow folder heads 62 extending upwardly above a plane containing the axes of the entrance and exit rollers, as shown in FIG. 1, and a downward second position rotated 180° from the upward position so that the plow folder heads 62 extend downwardly for use in upward folding of the web material, as shown in FIG. 3.

Lock means in the form of a releasable lock screw is adapted for locking threaded connection with suitable threaded bores in the stops 134*b* and 136*b* when the folder mechanism is in its downward rotational position, as in FIG. 7. The lock screws 138 are also adapted for threaded cooperation with suitable bores in the stops 134*a* and 136*a* to selectively releasably lock the folder mechanism in its upper rotational position.

As aforementioned, to maintain the folded web in its folded position downstream from the folder mechanism 60, a fold holding roller 46 of a length sufficient to extend across the full transverse width of the folded web is operatively associated with the exit idler roller 44 so as to provide a uniform fold holding pressure against the entire folded web surface. With particular reference to FIGS. 9 and 10, taken in conjunction with FIG. 11, the fold holding roller 46 has its opposite ends journaled on the ends of a pair of laterally spaced parallel support arms 140, the opposite ends of which are fixed to an axle or support shaft 142 on which the idler roller 44 is rotatably mounted. The arms 144 are such that the fold holding roller 46 extends across the width of the frame means in parallel spaced relation to the exit idler roller 44 to enable the folded web material to pass between the fold holding roller 46 and the idler roller 44 in a generally "S" fashion, as illustrated in FIG. 11.

To facilitate adjustment of the pressure applied by the fold holding roller 46 to the folded web, a control arm or lever 144 is fixed on at least one end of the axle or support shaft 142 outward of the frame member 14 to allow manual rotation of the shaft 142 and a corresponding rotational movement of the fold holding roller 46. Locking means in the form of a manual locking lever 146 has a threaded locking shaft 148 fixed thereon, the locking shaft extending into a threaded bore in a housing block 150 mounted on the outer surface of frame 14 so that the locking shaft is adapted to engage the end of the support shaft 142 and releasably lock it in a fixed adjusted position to maintain fixed position of the fold holding roller 46.

Thus, in accordance with the present invention, an improved apparatus for folding continuous length web is provided which facilitates adjustment during longitudinal movement of the associated web material so as to optimize folding of the web material without wrinkles or gussets being formed at the fold. By providing a plow folder head 62, or two plow folder heads as in the illustrated embodiment, one or a pair of laterally spaced longitudinal folds may be made in the web so that the folds fold either upwardly or downwardly, such option being afforded by the rotational or pivotal mounting of the folder mechanism 60 as described.

After initially manually inserting the web over the entrance rollers 24 and 34, the operator manually effects folding of one or both of the lateral edges of the web to the desired fold positions and then advances the folded web between the fold holding roller 46 and rear idler roller 44 to the driven rear exit roller 36. At this point, the power to the driven exit roller 36 is energized to jog the exit roller to advance the folded web out the exit side thereof to enable insertion through the compensator rollers 50 and 52 to, for example, the draw rollers on a cut-off and sheeter apparatus. As the web material is inserted between the entrance and exit rollers in this fashion, it is simultaneously placed either over or under the plow folder heads 62 which have previously been adjusted to the desired plow depth and also adjusted laterally for the desired fold width dependent upon the type of web material being folded, as is known.

After thus preparing the web material in the web folding apparatus 10, the exit draw roll 36 is energized, or the web material is drawn through the folder apparatus by an external power source, to automatically advance the web material through the folding apparatus, it being understood that the operator has initiated discharge of air or other fluid from the orifices 104 and 106 in the fold forming members 74 to establish fluid film lubrication between the fold forming members and the moving web.

At this time, should the operator notice wrinkling or gusseting at the fold line of the web, he merely releases one or both of the locking levers 94 and rotatably adjusts the associated fold forming member 74 about its rotational axis 90 to change the angular orientation of the associated fold surface 86 with the moving web until wrinkling or gusseting is eliminated. This adjustment is also similarly made should marking appear at the fold area. In the latter case, rotation of the fold forming member changes the orientation of the peripheral edge of the associated fold surface 86 so as to substantially remove it from contact with the folded web portion.

Since the fold surface 86 is planar and relatively solid across its face, except for the fluid orifices 106, the folded web portion cannot "crash back" after initial folding as has been experienced in known prior art devices with resulting wrinkling or gusseting of the web at the fold line. Operator adjustment of one or both of the fold forming members 74 about their rotational axes may be readily accomplished without concern for crashing back of the web material. Stated alternatively, the planar fold surface 86 provides sufficient surface support for the web that it does not crash back after folding, thereby eliminating wrinkling or gusseting. This phenomenon also takes place when adjusting the fold forming member 74 to eliminate any marking that may appear on the particular web material being folded.

Throughout operation of the folder apparatus 10, the operator may selectively vary the position of the fold holding roller 46 so as to maintain an optimum uniform pressure application across the entire surface of the folded web to prevent the folded portions from unfolding.

While preferred embodiments of the present invention have been illustrated and described, it will be understood that changes and modifications may be made therein without departing from the invention in its broader aspects. Various features of the invention are defined in the following claims.

What is claimed is:

1. In apparatus for folding web material which includes a frame, an entrance roller supported by said frame transversely thereof, an exit roller supported by said frame in parallel spaced relation from said entrance roller, and a plow folder supported intermediate said entrance and exit rollers and cooperative therewith to effect longitudinal folding of web material moved longitudinally from said entrance roller to said exit roller, the improvement wherein said plow folder includes a fold forming member having its longitudinal axis oriented substantially normal to the direction of web movement and having a cylindrical outer peripheral surface portion, said forming member having an end thereof formed by an axially outwardly facing generally planar fold surface lying in a plane subtending an acute angle with a plane transverse and normal to the longitudinal axis of said fold forming member, said fold forming member being cooperative with the web material so as to effect folding thereof at the area of intersection of said cylindrical surface portion with said fold surface as said web material is passed from said entrance to said exit rollers, said fold surface being operative to limit the extent of folding of said web material at said fold forming member during longitudinal movement of said web material.

2. Apparatus as defined in claim 1 wherein said fold forming member has a plurality of fluid passages intersecting its outer peripheral surface portion and being adapted for connection to a source of fluid so as to enable discharge of fluid to establish fluid lubrication between said fold forming member and the moving web material.

3. Apparatus as defined in claims 1 or 2 wherein said fold forming member is rotatable about its longitudinal axis so as to define a compound angle relation between the plane of said fold surface and the longitudinal axis of said fold forming member.

4. Apparatus as defined in claim 3 wherein said plow folder includes support bracket means adapted to be supported by said main frame in predetermined relation to said entrance and exit rollers, said support bracket means and said fold forming member having mutually cooperable indicator means thereon providing a visual indication of the angular rotational position of said fold forming member about its longitudinal axis relative to said support bracket means.

5. Apparatus as defined in claim 3 including means cooperable with said fold forming member to enable releasable locking of said fold forming member in a selected rotational position about its longitudinal axis while said web is moving longitudinally from said entrance roller to said exit roller.

6. Apparatus as defined in claim 1 wherein said plow folder includes at least one rotatable cylindrical web engaging roller coaxial with said fold forming member, the diameter of the outer peripheral cylindrical surface of said cylindrical web engaging roller being substantially identical to the diameter of said cylindrical outer peripheral surface portion of said fold forming member.

7. Apparatus as defined in claim 6 wherein said fold forming member has a plurality of fluid discharge orifices formed in its outer peripheral surface, said discharge orifices being adapted to discharge fluid outwardly therefrom so as to form a fluid lubrication film between said fold forming member and the web material moving between said entrance and exit rollers.

8. Apparatus as defined in claim 7 wherein said fluid discharge orifices are formed in said cylindrical outer peripheral surface portion of said fold forming member and in said fold surface.

9. Apparatus as defined in claim 7 wherein said fold forming member has an internal fluid plenum chamber adapted for connection to a source of fluid, said discharge orifices being in fluid communication with said plenum chamber.

10. Apparatus as defined in claim 6 wherein said plow folder includes a support bracket on which said fold forming member is releasably supported in a manner to enable said fold forming member to be interchanged with similar fold forming members having fold surfaces forming different angular relationships with their respective longitudinal axes.

11. Apparatus as defined in claim 6 wherein said plow folder includes a plurality of rotatable cylindrical web engaging rollers disposed in coaxial relation with said fold forming member.

12. Apparatus as defined in claim 11 wherein said plurality of rotatable cylindrical web engaging rollers are of substantially identical configuration, at least one of said cylindrical rollers having an axial mounting shaft enabling mounting of said fold forming member in coaxial relation thereon, each of the remaining cylindrical rollers having an axial support shaft enabling mounting of the support shaft of an adjacent cylindrical roller thereon in coaxial relation therewith.

13. Apparatus as defined in claims 1 or 6 wherein said fold forming member has a fold surface lying in a plane subtending an angle of between approximately 45 and 75 degrees with said plane transverse and normal to the longitudinal axis of the fold forming member.

14. Apparatus as defined in claim 1 wherein said fold surface comprises a planar non-interrupted surface, the outer peripheral edge of which is defined at least in part by the intersection of said planar surface with said cylindrical outer surface portion of said fold forming member.

15. Apparatus as defined in claim 1 including an idler roller supported by said frame in parallel relation to said exit roller between said exit roller and said plow folder so that the folded web engages the peripheral surface of said idler roller as it approaches said exit roller, a fold holding roller having a length sufficient to extend transversely across the folded portion of the web material, and means supporting said fold holding roller transversely of the moving web material for engagement with the outer exposed surface of the folded web material so as to prevent unfolding of said folded web, said support means enabling selective varying of the pressure applied by said fold holding roller against said folded web material.

16. Apparatus as defined in claim 15 wherein said support means includes support arm means operatively connected to said fold holding roller so as to enable pivotal movement of said fold holding roller about the axis of said idler roller while maintaining substantially parallel relation between said fold holding roller and said idler roller.

17. Apparatus as defined in claim 16 wherein said idler roller is rotatably mounted on an idler support shaft the opposite end of which are rotatably supported by said frame, said support arm means including a pair of laterally spaced support arms fixed on said idler support shaft, and including a control lever operatively associated with said idler support shaft so as to enable selective rotation of said support arms and fold holding roller about the axis of said idler support shaft.

18. Apparatus as defined in claim 17 including locking means cooperative with said idler support shaft and operative to enable releasably locking of said idler support shaft in selected rotational position relative to the frame.

19. Apparatus as defined in claim 1 wherein said frame includes laterally spaced side frame members, and further including guide track means disposed between said side frame members substantially parallel to the axes of said entrance and exit rollers, carriage means adjustably movable along the length of said guide track means, and support bracket means supporting said fold forming member on said carriage means in a manner enabling vertical adjustable positioning of said fold forming member relative to the path traversed by web material moved longitudinally from said entrance roller to said exit roller, said support bracket means including a pair of laterally spaced pivot plates pivotally mounted on said laterally spaced frame members for pivotal movement about a common pivot axis generally parallel to the axes of said entrance and exit rollers, said guide track means being mounted on said pivot plates eccentric to said common pivot axis so as to be pivotally movable about said common pivot axis with said pivot plates so as to enable substantially 180° pivotal movement of said plow folder about said common axis generally parallel to said entrance and exit rollers.

20. Apparatus as defined in claim 19 including stop means operatively associated with said frame members and said pivot plates so as to limit pivotal movement thereof and establish upwardly and downwardly disposed operating positions for said plow folder head relative to said plane containing the axes of said entrance and exit rollers for upward and downward folding of the web material.

21. Apparatus as defined in claim 20 including releasable locking means selectively cooperative with said pivot plates and said frame members so as to releasably lock said pivot plates in either of their said pivotal limit positions.

22. Apparatus as defined in claim 19 wherein said carriage means includes means enabling manual incremental movement along said guide track means and manual incremental positioning of said plow folder head relative to said carriage means, and indicator means operatively associated with said carriage means and said guide track means for visually indicating the relative position of said carriage means along said guide track means.

23. Apparatus as defined in claim 22 wherein said support bracket means has position indicating indicia thereon enabling visual observation of the relative position of said plow folder head relative to said guide track means.

24. Apparatus as defined in claim 19 wherein said plow folder mechanism includes a pair of carriages mounted on said guide track for adjustable positioning therealong, and support bracket means carried by each of said carriages and supporting a plow folder head on the associated carriage, said plow folder heads being operative to effect folding of web material along parallel laterally spaced fold lines and being adjustable transversely of the web material to selectively vary the width of each fold.

25. A plow folder for use in folding a web material as it is selectively moved in a substantially longitudinal direction, said plow folder including a fold forming member having a longitudinal axis and defining a cylindrical outer peripheral surface portion, said forming member having an end thereof formed by an axially outwardly facing generally planar fold surface lying in a plane subtending an acute angle with a plane transverse and normal to said longitudinal axis, and support bracket means facilitating selective adjustable mounting of said plow folder relative to a moving web material such that the longitudinal axis of said forming member is substantially normal to the direction of movement of said web material and said fold surface effects folding of said web material at the area of intersection of said cylindrical surface with said fold surface, said fold surface being operative to limit the extent of folding of said web at said fold surface.

26. A plow folder as defined in claim 25 wherein said fold forming member is mounted on said support bracket means in a manner enabling rotation of said fold forming member about its longitudinal axis so as to establish a compound angular relationship of said fold surface to said longitudinal axis.

27. A plow folder as defined in claim 26 including locking means cooperative with said fold forming member and operative to releasably lock said fold forming member in selected rotational relation to said support bracket means.

28. A plow folder as defined in claim 27 wherein said fold forming member and said support bracket means have mutually cooperable indicator means thereon providing an indication of the rotational position of said fold forming member about its longitudinal axis relative to said support bracket means.

29. A plow folder as defined in claims 25 or 16 wherein said fold forming member has a plurality of fluid discharge orifices formed in its outer peripheral surface and adapted for connection to a source of fluid to facilitate discharge from said orifices to enable forming of a fluid lubrication film between said fold forming member and a web material during folding thereof.

30. A plow foldeer as defined in claim 29 including at least one cylindrical web engageable roller rotatably mounted on said support bracket in coaxial relation with said fold forming member, said cylindrical web engageable roller having an outer diameter substantially equal to the diameter of said cylindrical surface portion of said fold forming member.

31. A plow folder as defined in claim 30 wherein said plow folder includes a plurality of said rotatable cylindrical web engaging rollers disposed in coaxial relation with said fold forming member.

32. A plow folder as defined in claim 31 wherein said plurality of rotatable cylindrical web engaging rollers are of substantially identical configuration, at least one of said cylindrical rollers having an axial mounting shaft enabling mounting of said fold forming member in coaxial relation thereon, each of the remaining cylindrical rollers having an axial support shaft enabling mounting of the support shaft of an adjacent cylindrical roller thereon in coaxial relation therewith.

33. A plow folder as defined in claim 25 wherein said fold forming member has a fold surface lying in a plane subtending an angle of between approximately 15 and 45 degrees with said plane transverse and normal to the longitudinal axis of the fold forming member.

* * * * *

UNITED STATES PATENT AND TRADEMARK OFFICE

CERTIFICATE OF CORRECTION

PATENT NO. : 4,421,501

DATED : December 20, 1983

INVENTOR(S) : Bruce A. Scheffer

It is certified that error appears in the above-identified patent and that said Letters Patent is hereby corrected as shown below:

In listing of cited references, the inventor of U.S. Patent No. 2,023,734 should be changed from "Lomatsch" to --Lamatsch--.

In the abstract, line 11, "folder" should be --fold--.

Column 2, line 3, "coperate" should be --cooperate--.

Column 2, line 32, "of" (first occurrence) should be --to--.

Column 4, line 27, "againt" should be --against--.

Column 6, line 59, "ca" should be --can--.

Column 8, line 14, "84" should be --74a'--.

Column 8, line 16, "74'" should be --84'--.

Claim 17 (Column 13, line 7) "end" should be --ends--.

UNITED STATES PATENT AND TRADEMARK OFFICE

CERTIFICATE OF CORRECTION

PATENT NO. : 4,421,501

DATED : December 20, 1983

INVENTOR(S) : Bruce A. Scheffer

It is certified that error appears in the above—identified patent and that said Letters Patent is hereby corrected as shown below:

Claim 29 (Column 14, line 46) "16" should be --26--.

Claim 30 (Column 14, line 53) "foldeer" should be --folder--.

Signed and Sealed this

*Seventeenth* Day of *April 1984*

[SEAL]

*Attest:*

GERALD J. MOSSINGHOFF

*Attesting Officer*

*Commissioner of Patents and Trademarks*